United States Patent [19]

Clark

[11] 4,420,102

[45] Dec. 13, 1983

[54] AUTOMATIC CONTOURING NAPKIN RING

[76] Inventor: Lloyd D. Clark, 15 Conrad St., San Francisco, Calif. 94131

[21] Appl. No.: 263,899

[22] Filed: May 15, 1981

[51] Int. Cl.[3] ..... A41H 33/00

[52] U.S. Cl. ..... 223/34; D7/72; 24/7; 40/21 R; 223/37

[58] Field of Search ..... 223/34, 37, 38; D7/72; 40/21 R; 24/7-9; 2/152 R

[56] References Cited

U.S. PATENT DOCUMENTS

| | | | |
|---|---|---|---|
| D. 141,501 | 6/1945 | Pentz et al. | D7/72 |
| 705,196 | 7/1902 | Bergmann | 24/7 |
| 1,771,328 | 7/1930 | Gabel | 223/37 |
| 3,235,880 | 2/1966 | Hypps | 2/152 R |
| 3,965,591 | 6/1976 | Le Sueur | D7/72 |

*Primary Examiner*—Louis Rimrodt
*Attorney, Agent, or Firm*—David Pressman

[57] ABSTRACT

A napkin ring which easily and quickly imparts a decorative shape to a napkin inserted therein comprises an annular-shaped external member 2 having a cantilevered tongue 4 extending from an inside surface of said external member toward and past the center of the annulus. The free end of the tongue has a pair of arms 16 extending therefrom and curved back toward the base of the tongue. A napkin is shaped by inserting a corner thereof 8 between the free end of the tongue and the annulus and pulling the napkin about halfway into the ring where it will be forced into a decorative shape between the tongue and the ring.

11 Claims, 7 Drawing Figures

NAPKIN RINGS

CIRCULAR SHAPING
RINGS

NAPKIN INTRODUCED

NAPKIN PARTIALLY INSERTED

NAPKIN FULLY INSERTED

TIP FOLDED UP AROUND RING-SIDE VIEW

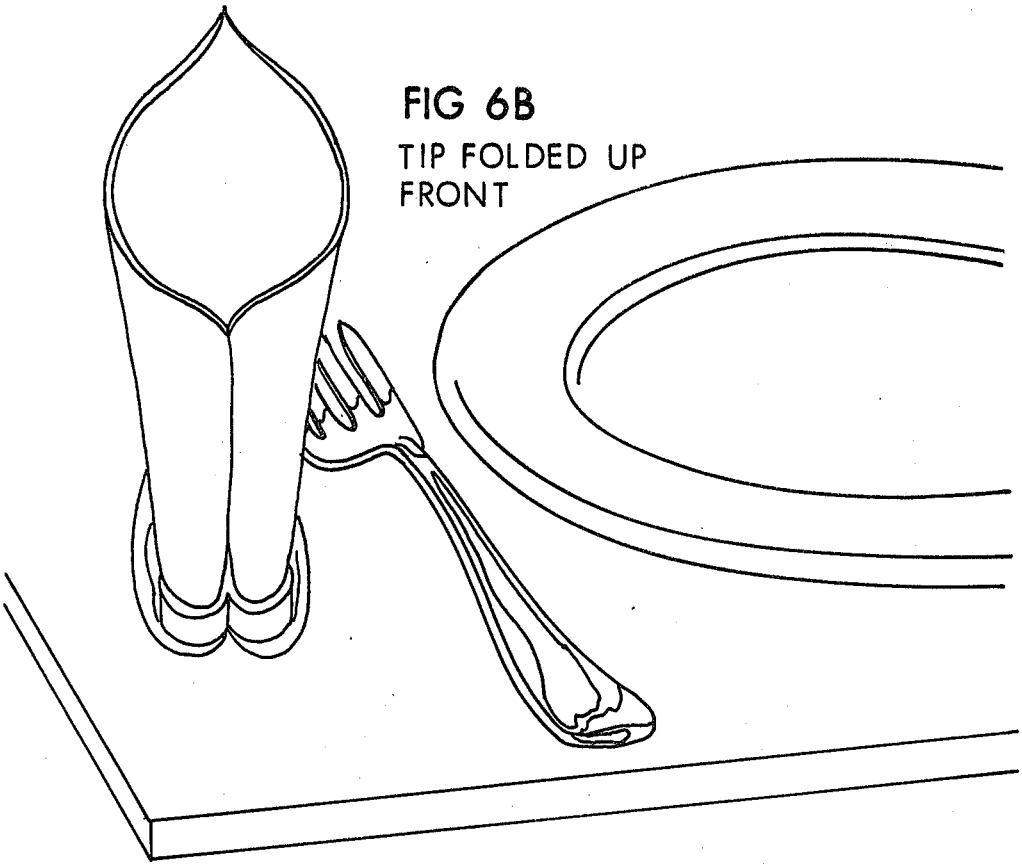
FIG 6B
TIP FOLDED UP
FRONT
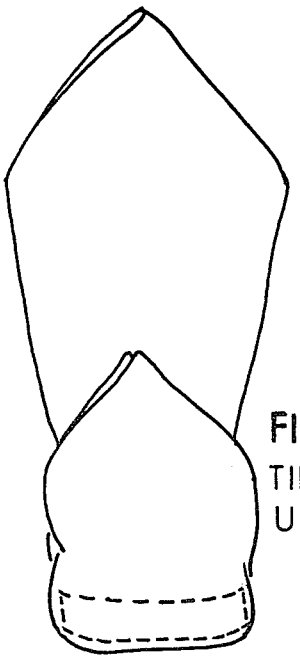
FIG 6C
TIP FOLDED
UP - BACK
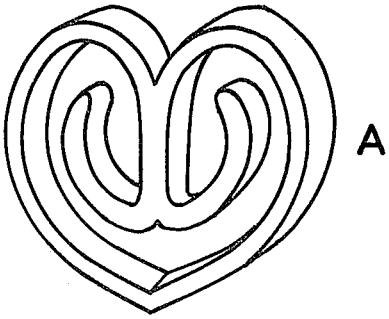
A
FIG 7
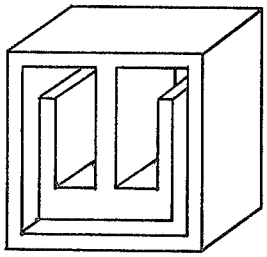
B

AUTOMATIC CONTOURING NAPKIN RING

BACKGROUND

1. Field of the Invention

This invention relates to napkin rings. In particular it relates to a napkin ring which contours the napkin as it is drawn into the ring.

2. Discussion of Prior Art

Prior art napkin rings have consisted of open, truncated cylindrical shapes. To use these rings, the napkin is first folded or rolled into a shape sufficiently compact to permit its insertion into the ring. The napkin is then inserted into the ring, which will hold it in this folded or rolled shape. No shaping of the napkin is done by the ring.

In lieu of restraining the napkin with a napkin ring, napkins are often folded to enhance the beauty of a table setting. Beautiful and decorative shapes can be attained by manual folding of the napkin. The folding operation is time comsuming and requires a high degree of manual dexterity. It would be desirable to provide means for imparting more beautiful and distinctive shapes to napkins than are available with present napkin rings, while avoiding the drawbacks encountered in napkin folding.

An alternative method of achieving and maintaining a decorative shape is to first fold the napkin, then insert it into the ring, using the napkin ring as a restraining device after the napkin has been folded. Again, patience and a high degree of manual dexterity are required of the user since the napkin must be folded before it is inserted into the ring.

Additionally great care must be exercised during folding if it is desired to replicate the same shape over a number of napkins. It would be desirable if a simple and rapid contouring means could be applied identically to a plurality of napkins.

OBJECTS

Accordingly it is one object of my invention to provide a novel napkin ring. Another object is to provide means whereby napkins can be quickly given an attractive, contoured shape. Yet another object is to provide a napkin ring which permits the user to produce decoratively contoured napkins with a minimum of manual dexterity. Yet another object of my invention is to provide a napkin ring which consistently imparts the same shape to the napkin each time the napkin is inserted into the ring. Still another object of my invention is to provide a new article of tablewear.

Still further objects and advantages of my invention will become apparent from a consideration of the drawings and ensuing description thereof.

DRAWINGS:

In the drawings, which are not to scale:

FIGS. 1A and B show two prior art napkin rings in use.

Figure 6A:
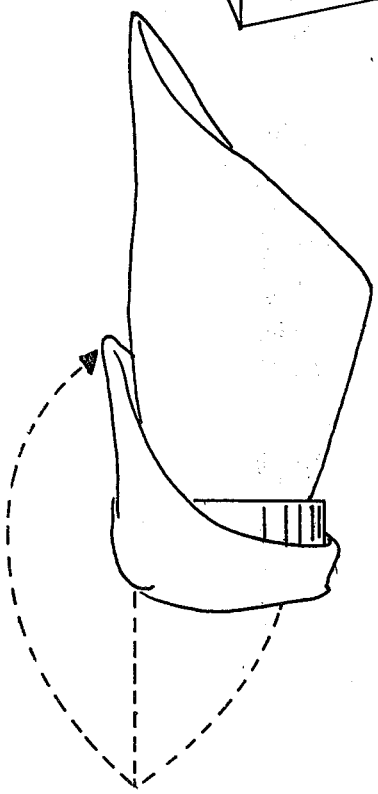

FIGS. 6A, B and C show an additional folding step and two views of a further ramification of the preferred embodiment.

FIGS. 7A and B show two other possible shapes of the napkin ring.

Figs. 1A AND B--PRIOR ART NAPKIN RINGS IN USE

FIGS. 1A and B show two common prior art napkin ring shapes with napkins inserted. These rings assume many cross-sectional shapes. They are typically 5 mm (0.2 inch) to 40 mm (1.57 inches) in length. A circular ring and a square ring are shown. The diameter of the circular ring is typically 38 mm (1.25 inches). The square ring is typically 38 mm (1.25 inches) on a side. They may be made from a wide variety of materials including plastics, bone, various metals, ceramics, etc. The napkins are first rolled (FIG. 1A) or folded (FIG. 1B) prior to insertion in the ring. They are then inserted into the napkin ring and the assembly is then placed on the dining table. While these rings provide a decorative touch for the dining table, they do not impart a distinctive and novel shape to the napkins they hold. They only maintain the shape given the napkin by the user prior to insertion.

Figure 2:
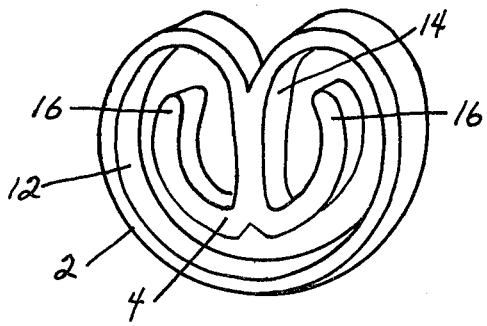
FIG. 2 is a perspective drawing of one embodiment of the present invention.

Fig. 2--CIRCULAR SHAPING RING

According to the present invention, a napkin ring is provided which automatically contours a napkin upon insertion. A first embodiment of a ring according to the invention is shown in perspective view in FIG. 2. The ring comprises an annular part 2, of circular shape. A tongue or member 4 extends into the center of the ring from an interal side 12 of annular part 2. Tongue 4 is anchor shaped, having a rectangular cross-sectioned cantilevered elongated member or shaft 14 and rectangular cross-sectioned cantilevered arms 16 extending out and curved back from opposite sides of the end of member 14 distal from annular part 2. Tongue 4 acts to shape the napkin as it is drawn into the ring and further to hold the napkin's shape once it is in the ring.

Arms 16 preferably are identical, but they may be asymmetrical, in which case asymmetrical napkin shapes will be obtained. Arms 16 and member 14 lie within the parallel plane boundaries of annular part 12, but can extend partly out therefrom. Ring part 2 preferably is about 13 mm (0.5 inch) thick in the axial direction, about 3.2 mm (⅛ inch) thick in the radial direction, about 51 mm (2 inches) in overall diameter, and tongue member 4 about 3.2 mm (0.125 inch) wide and 38 mm (1.5 inches) long overall, with arms 16 about 32 mm (1.25 inches) long overall and extending out from member 14 about 13 mm (0.5 inch).

Figure 3:
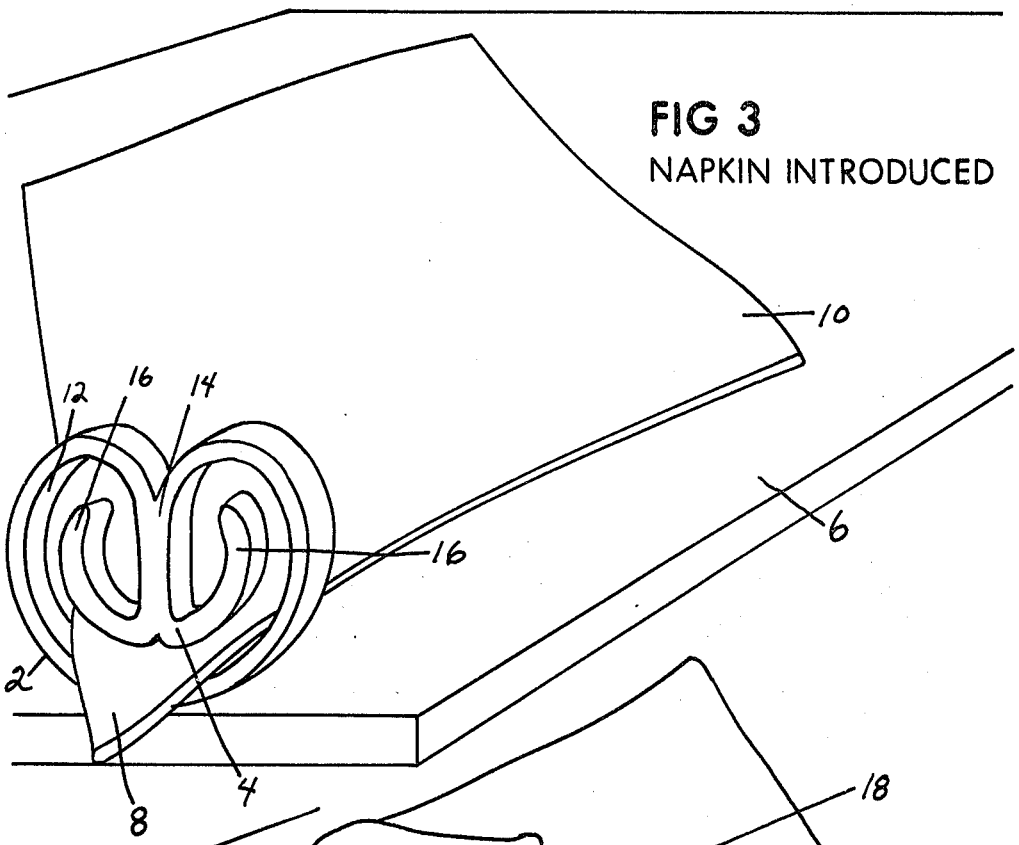
FIG. 3 shows the preferred embodiment of the present invention just as the tip of the napkin is inserted into the ring.

Fig. 3--PREFERRED EMBODIMENT OF THE PRESENT INVENTION IN USE

Before decorative folding or insertion in either prior art napkin rings or the preferred embodiment of the present invention, napkins are generally ironed and then folded twice so that they are folded into quarters. A typical napkin prior to folding into quarters is 45.7 cm (18 inches) on a side. After folding, the napkin ready for decorative folds or insertion into napkin rings is 22.9 cm (9 inches) on a side.

In use, the napkin ring of the present invention is first rested on a flat surface 6 such as a dining table, as shown. The user inserts tip 8 (previously the center) of napkin 10 from one side. Tip 8 is passed through the ring and slightly out the opposite side so that it may be gripped by the user, as shown.

Figure 4:
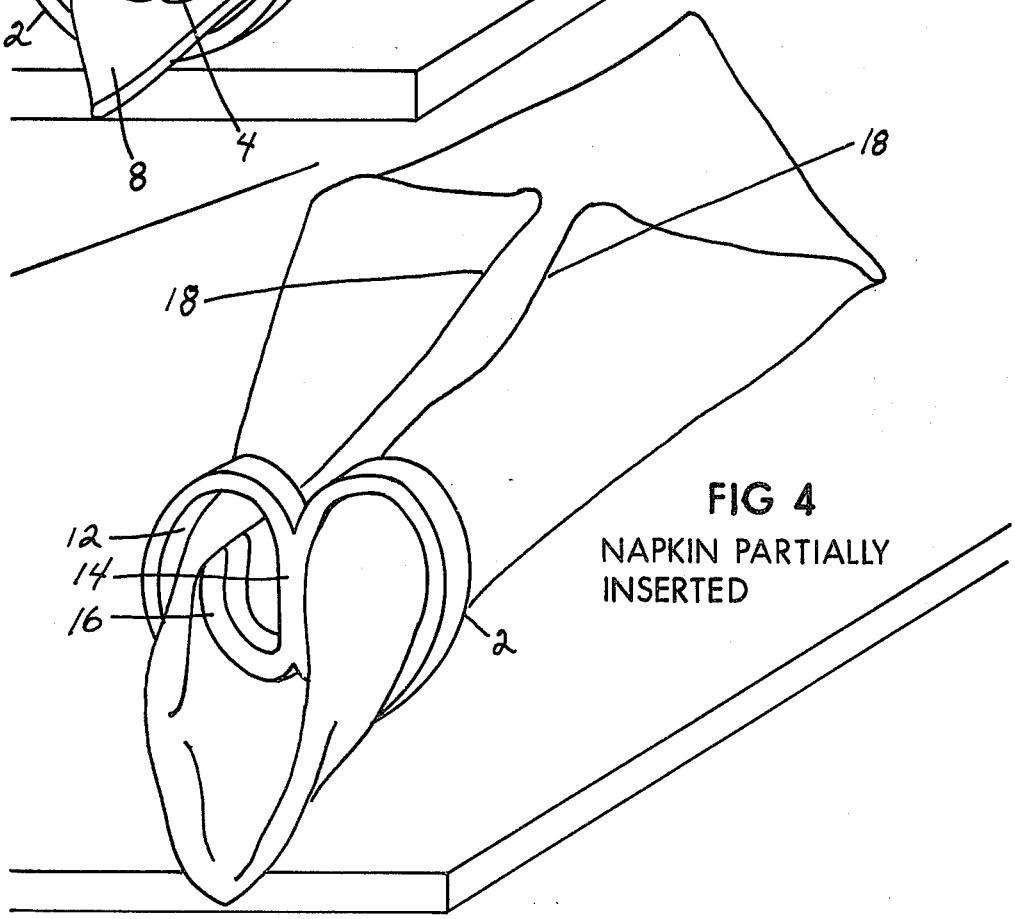
FIG. 4 shows the preferred embodiment when the napkin is part-way into the ring.

Fig. 4--NAPKIN PARTIALLY INSERTED

The principle of operation of the present invention is shown in FIG. 4. as the napkin is drawn into the ring, the inside surface 12 of the ring lifts the side of napkin 10 which was originally in contact with table 6 upward, forcing it to follow the shape of inside surface 12.

As the napkin is pulled further through the ring, arms 16 prevent its collapsing into the center of the ring. The space between inside surface 12 and arms 16 provides a channel, which is the only path napkin 10 may take as it is pulled into the ring. Thus napkin 10 will assume the shape of the path determined by inside surface 12 of the ring and the outer surface of arms 16.

As napkin 10 progresses into the ring, edges 18 of napkin 10 follow the curve of inner surface 12 until they encounter shaft 14. Edges 18 move along inside surface 12 past the base of 14 and follow the shape of the sides of shaft 14.

Figure 5:
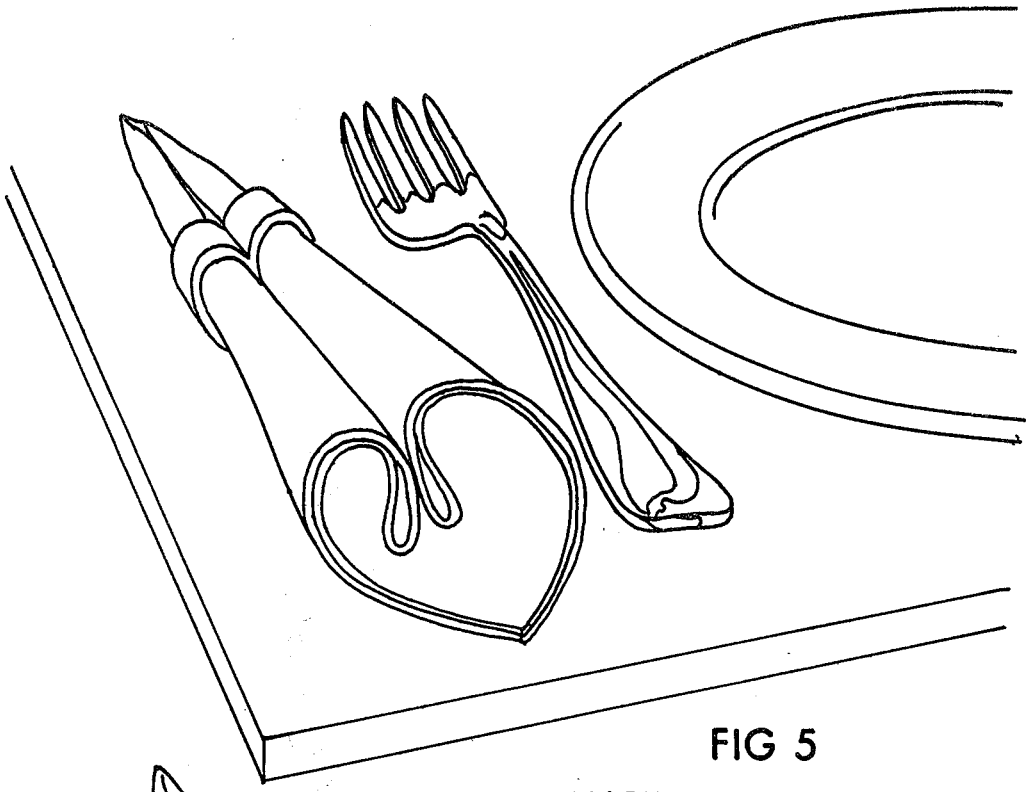
FIG. 5 shows the preferred embodiment with the napkin fully in place.

Fig. 5--NAPKIN FULLY INSERTED IN THE RING

When edges 18 reach the inner surfaces of arms 16, insertion of the napkin is stopped and napkin 10 is fully inserted as shown in FIG. 5.

Figure 1:
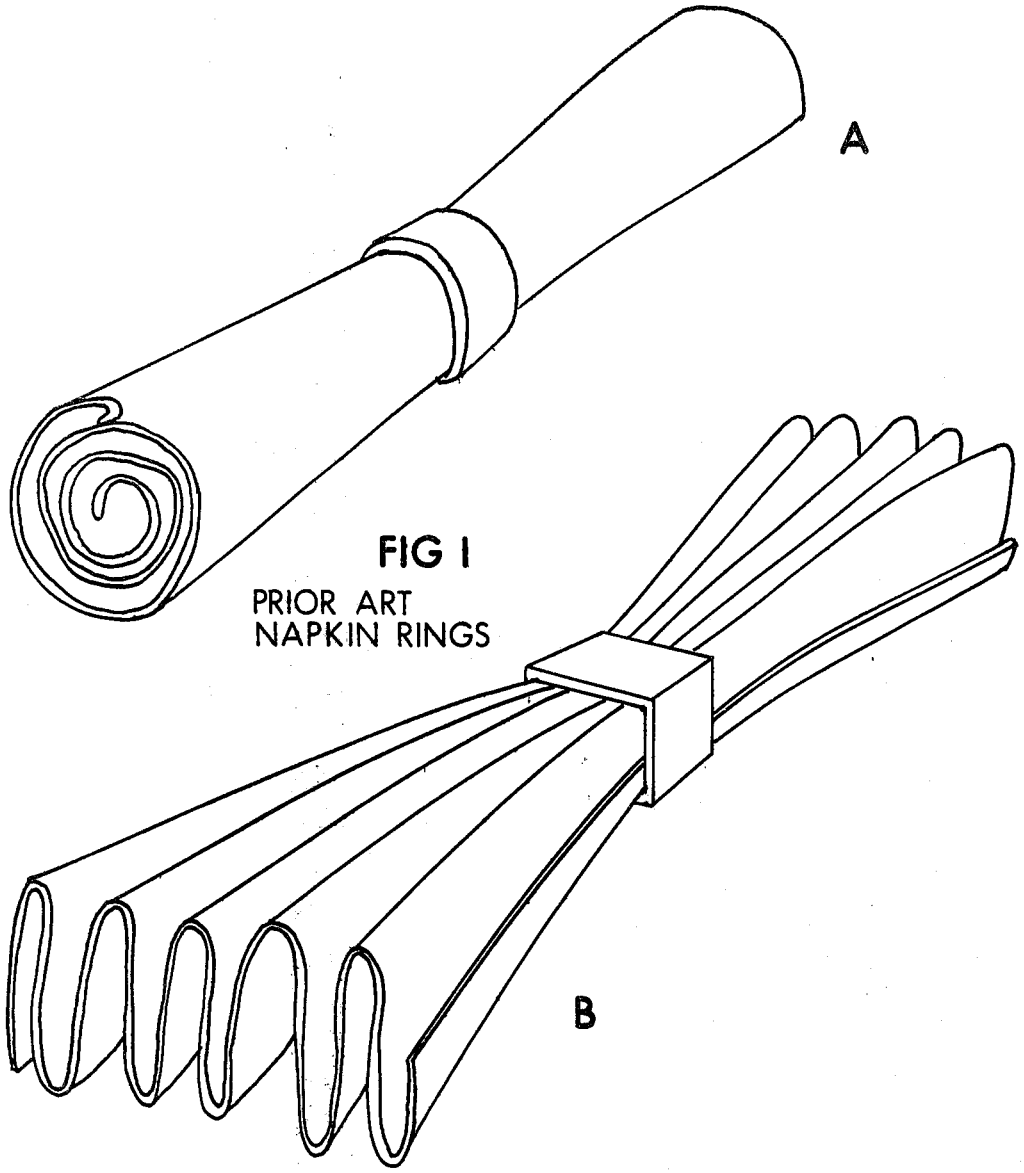
FIG 1 PRIOR ART

The napkin-ring assembly now is ready for use at a place setting, and has an attractive, ornamental highly aesthetic, flowerlike shape, vastly more pleasing and decorative than those of FIG. 1.

Fig. 6--ALTERNATIVE MEANS OF DISPLAYING THE NAPKIN AND RING

After napkin 10 is fully inserted, as shown in FIG. 5, its tip 8 may be folded up and around the ring, as shown in the side view of FIG. 6A. The napkin and ring assembly may then be stood upright, as shown in FIGS. 6B (front view) and 6C (rear view). The assembly now has a striking, fancy, yet more compact appearance, yet can be created with no skill, minimal effort, and less time than would be required to fold or roll the napkin, as shown in FIG. 1.

it is seen that the napkin ring of the invention combines a rapid contouring operation with a restraining action such that as the napkin enters the napkin ring it is constrained to follow a predetermined path and then restrained in a reproducible, predetermined shape, thus quickly providing a more distinctive and beautiful shape than is possible with prior art napkin rings and without resorting to time-consuming, skill-demanding folding of the napkin.

While the above description contains many specifities, these should not be construed as limitations on the scope of the invention, but rather as an exemplification of one preferred embodiment thereof. Many other variations are possible, for example the alternative shapes shown in FIGS. 7A (heart shaped) and 7B (square shape). Other shapes (diamond, oval, etc.) are possible. Tongue 4 would have a complimentary shape in each case so that a well-defined channel would be provided to guide edges 18 of napkin 10, as discussed above. In lieu of cantilevered arms 16 extending out and back from the distal end of member 14, the end of member 14 can be widened into a bulbous-shaped head, a square- or rectangular-shaped head, or in lieu of head, member 14 can gradually widen from annular part 2, either linearly or in a gradual curve. Alternative shapes do not affect the principle of operation but do permit variations in the final shape for variety. Accordingly, the scope of the invention should be determined not by the embodiment illustrated, but by the appended claims and their legal equivalents.

I claim:

1. A napkin-shaping ring comprising an annular-shaped external portion, a cantilevered member extending from a part of an inside surface of said annular-shaped external portion toward the center of said annular-shaped external portion, a portion of said cantilevered member remote from said part of said inside surface of said annular-shaped external portion being wider than the rest of said cantilevered member, the internal height of said annular-shaped external portion, measured from said part of said inside surface thereof to the opposite inside surface thereof, approximating the internal width of said annular-shaped external portion, measured perpendicularly to said height measurment direction, such that when a cloth napkin is inserted, tip first, between the free end of said cantilevered member and said opposite inside surface of said anular-shaped external portion, and drawn about halfway into said ring, it will (a) be forced around between the inside surface of said annular-shaped external portion and said wider part of said cantilevered member to meet the opposite sides of the rest of said cantilevered member between said wider part thereof and said part of said inside surface of said annular-shaped external portion and (b) be forced to conform to the general shape defined by the internal structure of said napkin ring.

2. The napkin ring of claim 1 wherein the depth dimension of said annular-shaped external portion and said cantilevered member, measured perpendicularly to said height and width dimensions, is about one quarter of the height or width of said annular-shaped external portion.

3. The ring of claim 1 wherein said cantilevered member has a pair of arms extending out from opposite sides thereof.

4. The ring of claim 3 wherein said extending arms curve back toward said part of said inside surface of said external portion.

5. The ring of claim 3 wherein said arms extend from said end of said cantilevered member remote from said part of said inside surface.

6. The ring of claim 1 wherein said external portion has a circular shape.

7. The ring of claim 1 wherein said cantilevered member lies entirely within the volume enclosed by said external portion.

8. The ring of claim 1 wherein said cantilevered member has a rectangular cross section.

9. The ring of claim 1 wherein said external portion has a V-shaped depression on the outside surface thereof on the other side of said external portion from said part of said inside surface thereof.

10. The ring of claim 9 wherein the part of said external portion across said external portion from said part of said inside surface thereof has a V-shaped convex shape, whereby said external portion is heart-shaped.

11. The ring of claim 1 wherein said external portion has a rectangular shape, said cantilevered member extending from the center of one of the four sides thereof.

* * * * *